United States Patent [19]

Bock

[11] Patent Number: 5,022,546

[45] Date of Patent: Jun. 11, 1991

[54] CONTAINER FOR THE STORAGE AND TRANSPORT OF, IN PARTICULAR, BULK MATERIALS SUCH AS CONSTRUCTION DEBRIS, RUBBISH, INDUSTRIAL WASTE AND THE LIKE

[75] Inventor: Normann Bock, Syke-Barrien, Fed. Rep. of Germany

[73] Assignee: Edelhoff M.S.T.S. GmbH, Iserlohn, Fed. Rep. of Germany

[21] Appl. No.: 347,884

[22] PCT Filed: Jul. 1, 1988

[86] PCT No.: PCT/DE88/00405

§ 371 Date: Mar. 9, 1989

§ 102(e) Date: Mar. 9, 1989

[30] Foreign Application Priority Data

Jul. 10, 1987 [DE] Fed. Rep. of Germany ..... 3722889

[51] Int. Cl.[5] ..... B65D 21/02

[52] U.S. Cl. ..... 220/4.03; 220/4.27; 220/908; 206/506; 206/511; 206/512

[58] Field of Search ..... 206/505, 506, 509, 511, 206/512; 220/4 A

[56] References Cited

U.S. PATENT DOCUMENTS

| | | | |
|---|---|---|---|
| 1,192,847 | 6/1933 | Klepel | 206/509 |
| 1,891,811 | 12/1932 | Grimes | 206/509 |
| 2,053,969 | 9/1936 | Olds | 206/511 |
| 2,828,023 | 3/1958 | Berra | 206/512 |

FOREIGN PATENT DOCUMENTS

| | | | |
|---|---|---|---|
| 0066683 | 12/1982 | European Pat. Off. | 206/518 |
| 2507481 | 9/1976 | Fed. Rep. of Germany | 206/506 |
| 2641683 | 3/1978 | Fed. Rep. of Germany | 206/509 |
| 497781 | 9/1954 | Italy | 206/509 |
| 1178661 | 9/1985 | U.S.S.R. | 206/509 |
| 330038 | 6/1930 | United Kingdom | 220/4 A |

*Primary Examiner*—Stephen Marcus
*Assistant Examiner*—S. Castellano
*Attorney, Agent, or Firm*—Collard, Roe & Galgano

[57] ABSTRACT

Container for the loading of bulk materials, such as construction debris, rubbish, industrial waste and the like which, for purposes of interstackability, displays outwardly slanting sides and glide elements enabling it to slide fully supported along the upper longitudinal edges of the container immediately below it in the stack, which edges function as longitudinal guides. To achieve this additonal interstackability, in particular with filled containers, glide elements, adjustable with respect to position, have been provided on the container. The guide elements are in such a way that when in their end position in the lower section of the container, they are positioned over the respective longitudinal edge of the container located immediately below it in the stack. Each glide element is arranged on a positioning element which is secured in adjustable, movable position on the container by a locking element mounted on the container.

15 Claims, 3 Drawing Sheets

Figure 1:
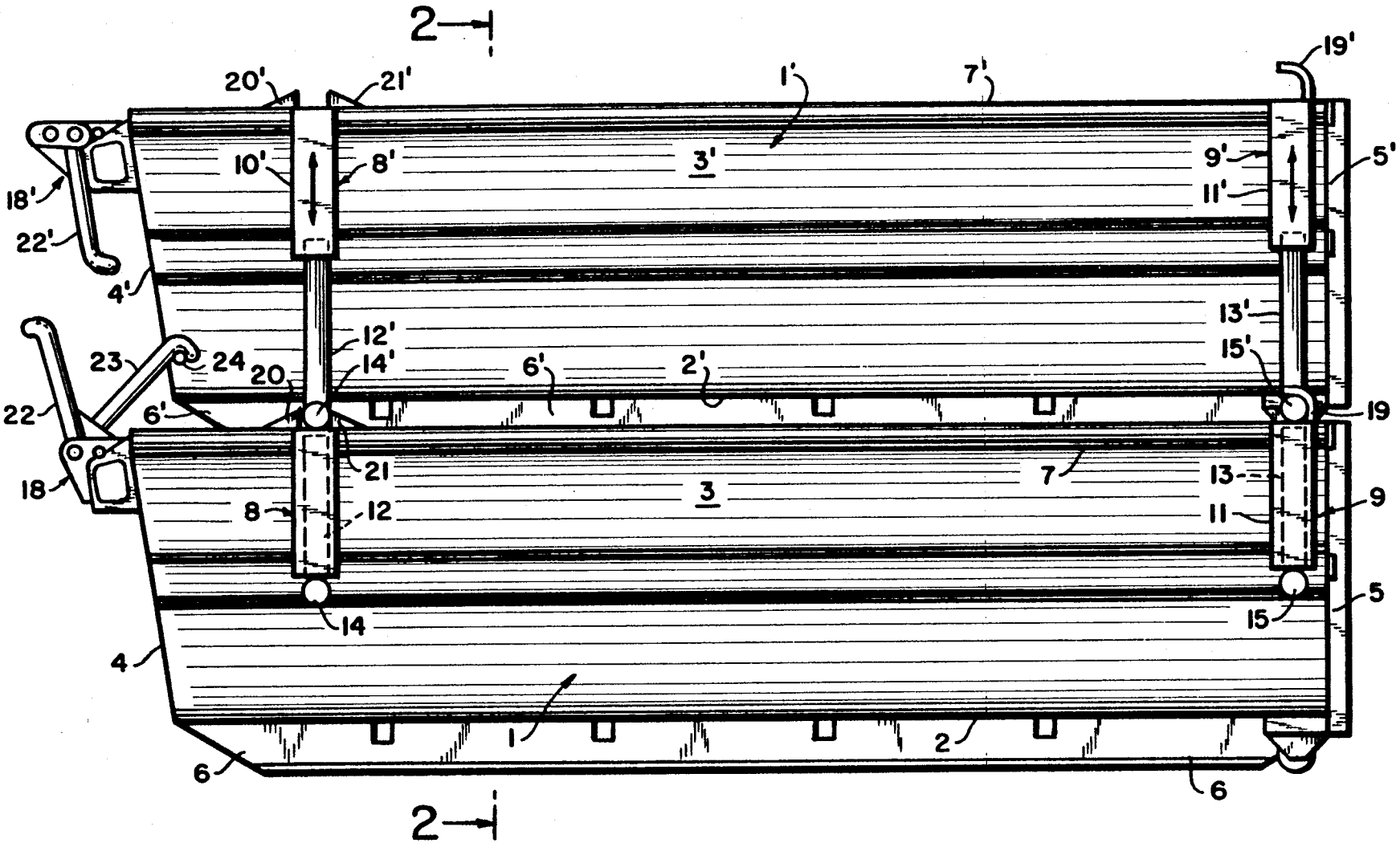

CONTAINER FOR THE STORAGE AND TRANSPORT OF, IN PARTICULAR, BULK MATERIALS SUCH AS CONSTRUCTION DEBRIS, RUBBISH, INDUSTRIAL WASTE AND THE LIKE

The invention relates to a container for the loading of bulk materials, such as construction debris, rubbish, industrial waste and the like which, for purposes of interstackability, displays outward slanting sides and glide elements enabling it to slide fully supported along the upper longitudinal edges of the container immediately below it in the stack, which edges function as longitudinal guides.

Containers of the above-described kind have been disclosed in the German Patent Specification No. 25 07 481. Such containers are customarily set up at the side where the corresponding bulk materials are generated. Resulting bulk materials are collected in the containers and, as soon as the container is filled, it can be removed by the appropriate vehicles. Generally, trucks are used for such container removal. They are equipped with devices which are also known under the designation of sliding lift-on lift-off bulk container tipper vehicles. These containers known in the art, as disclosed in Patent Specification No. 25 07 481, offer the advantage that, with the aid of such sliding lift-on lift-off bulk container tipper vehicles currently in use, they can be nested one inside the other and loaded onto trucks in stacks. The interstackability of the empty containers results in economic advantages in the storage of the empty containers and, primarily, in the transporting of the empty containers to their delivery site.

So that these containers known in the art can even be nested one inside the other they exhibit outward slanted walls. This results in the bottom surface area of a container being smaller than the area encompassed by the upper edges of that container. However, once these containers are filled, they can no longer be nested one into the other in stack formation. Consequently, the economic advantages to be derived from stacking with regard to container storage and transport, can no longer be achieved when the containers are filled. Every filled container must be individually transported and requires, for the period of its storage until the final point of unloading, that physical space occupied by it.

The object of the invention is to configure containers of the kind identified in Patent No. 25 07 481 in such a way that they can also be stacked when they are filled.

This object is accomplished by the invention in that, to achieve this additional interstackability, glide elements, adjustable with respect to position, have been provided on the container in such a way that when in their end position in the lower section of the container they are positioned over the respective longitudinal edge of the container located immediately below it in the stack. The glide elements provided to achieve this additional interstackability can be mounted on the container, in which case they are folded out, slid out, pivoted out, or the like, into their end position enabling interstacking. The adjustable glide elements may be additional glide elements located in the lower section of the container, that is, there are also glide elements for the purpose of interstackability, such that empty containers can be interstacked, as before, and which, through adjustment of the corresponding glide elements to their end position, can also be interstacked when they are filled.

The additional glide elements enabling interstackability may also be separately connected to the containers and are only then inserted into the corresponding receptacle components whenever the filled containers are to be stacked on top of each other.

It is also possible—and this has been provided for in the container configuration according to the invention—to make the existing glide elements already used to enable interstackability adjustable with respect to position in such a way that shifted into the aforementioned lower end position to enable the additional interstackability.

Two respective glide elements, positioned one behind the other, to be supported on a respective longitudinal edge have been provided for the purpose of achieving sure interstackability of the filled containers.

The glide elements can be massive glide shoes or the like. To reduce sliding friction, however, each glide element is expediently configured as a pivoted roller. The glide elements or rollers permit a traveling movement of the container both during stacking and during unstacking on the longitudinal edges of the container immediately below it in the stack.

Each glide element is arranged on a positioning element which is secured in an adjustable, movable position on the container by a locking element mounted on the container. Locking elements for the positioning elements can be externally mounted, specifically in appropriate sections out of which the glide elements, when the adjusting element is shifted, slide into the respective, desired position enabling the stacking hereinbefore described. Positioning elements can also be separately connected to the locking elements such that a simple shifting of the positioning elements causes the glide elements located on the positioning elements to slide into the respective, desired position. Positioning elements can be pivoting arms, hinged arms, plug-in arms or the like. Each locking element is preferably a receptacle mounted on the container, where the adjusting element is, relative to the receptacle, a movable bar component. A hollow section can expediently serve as the receptacle and in this configuration the bar component is a sectional rod taken up into the hollow section. The sectional rod, on whose unengaged end the glide element or roller is mounted can, for example, if so required, be simply inserted or slid into the hollow section which functions as the receptacle. In a preferred configuration, however, the bar component, which consists of a sectional rod, is longitudinally slide-guided in the hollow section which functions as the receptacle. In this configuration, each receptacle is externally mounted on the sides in the upper section of the container in an approximately perpendicular alignment, with the particular advantage that the glide elements, through a simple sliding in and sliding out of the bar components functioning as positioning elements, can be moved into two end positions, respectively. When the adjusting element is completely slid in, each glide element will be in the upper section of the container, thus enabling the internesting of containers, as disclosed in the German Patent Specification No. 25 07 481. By withdrawing the positioning elements functioning as bar components from the receptacles, the glide elements shift to the lower section of the container. There they are in an adjusted end position which corresponds approximately to the level of the bottom of the container, with the result that, in this advantageous configuration, the containers, when filled,, can also be stacked on top of each other.

It is, of course, also possible to mount each receptacle under the bottom of the container in an approximately horizontal alignment. In such a configuration, the container is equipped with glide elements located in its upper section, as described in Patent No. 25 07 481, but, however, is displaying yet additional glide elements located in the bottom section which function to interstack the filled containers and which, with respect to the receptacles mounted in more or less horizontal alignment, are movable. The glide elements are then again secured to bar components which are pivotable or extendable within the receptacles mounted under the bottom of the container. This arrangement of additional glide elements is particularly suited for the retrofitting of containers already in service with the elements and features of the present invention to achieve interstackability of filled containers. The bar components located in the receptacles under the bottom of the container preferably display, in their terminal sections which face the glide elements, an offset which makes it possible to achieve several advantages. The offset can, through simple shifting, bring about several end positions of the glide elements. The offset can also facilitate guiding of the containers to be stacked on top of each other.

Of course, locking elements to lock either of the end positions of the glide elements in place have been provided. These can, for example, be simple intercongruent bores in the bar component and in the receptacle where a connector pin can be plugged through the bores to lock the end position in place. Other locking elements are conceivable, for example, spring-tensioned pawls or the like which are particularly preferred for use with the slide guide for the positioning elements equipped with glide elements.

The use of simple connector pins, however, has the advantage that the positioning elements along with the glide elements can be detached from the containers. When the lower glide elements have been detached, only the receptacles remain on the containers. If hollow sections are used as the receptacles, they can be used to plug in other additional parts. The preferred embodiment comprises receptacles, shaped like simple hollow profiles, for example. These are externally mounted on the sides in the upper section of the container in approximately perpendicular alignment. Additional hardware fittings, for example clamping media, can, when the glide elements have been detached, be positioned in the open topped receptacles. This is to secure the containers to the transport media, such as railroad cars, water vehicles and the like. Also covers, for example, hatch-like parts, can be used to cover the otherwise open topped container.

Moreover, bolting down elements have been provided to secure interstacked containers during transit. The bolting down elements include projections which protrude from the longitudinal edges into the sliding path of the glide elements. Up against these projections the respective glide elements supported on these edges will stop in the final stacking position. Also included is at least one actuable clamping bolt. The projections secure containers stacked on top of each other to the extent that any unintended movement of the container along the longitudinal edges of the container immediately below it in the stack is prevented during transport of a stack of containers. The clamping bolts tighten the interstacked containers against each other. Interstacked containers are, by virtue of these bolting down elements, consequently adequately interconnected.

Of particular advantage is a rear projection of the bolting down elements shaped like a claw finger projecting from the longitudinal edge and which, laterally and from the top, engages in hook-like fashion a rear glide element supported on the respective longitudinal edge. During the interstacking process, the glide elements, for example, the glide elements on a supposed common axle, enter into the hooked mouth-like opening of the claw fingers. The result is that the claw fingers also determine the end positions of the traveling movement of the container during its stacking onto the respective container located immediately below. Of course, corresponding receptacle pockets or the like can also take over the functions of the claw fingers. Similarly, the glide element need not necessarily engage the hooked mouth-like opening of a claw finger or a receptacle pocket. Instead, the axle on which a roller serving as a glide element is located, or the corresponding adjusting element on which the glide element itself is located, can for example be, a bar component configured as a sectional rod. This rod can be engaged by the claw finger in order to effect container interlocking within a stack.

A forward projection clasps two blocks positioned one behind the other and accommodates a glide element between them. These blocks exhibit oblique ascending and descending slopes on the sides facing away from each other. In the formation of a stack, the glide elements travel along the longitudinal edges. They reach their end position in the stack in the course of this traveling movement. If the glide elements move up an ascending slope, and then fall between both blocks of the projection, after which point they are prevented from further movement. It is also possible to connect at least one of the blocks separately to the longitudinal edge. The blocks can then be inserted into the longitudinal edges in order to prevent the forward glide elements of a stacked container from advancing further along the longitudinal edge of the container immediately below it in the stack.

The interstacked containers are bolted down by the claw fingers in the rear section, that is, in the end position of a movement required to create the stack. Thus the front projections consisting of two blocks can not, however, prevent potential lifting up of the front glide elements from the longitudinal edges of the container immediately below it in the stack. Hence at least one actuable clamping bolt has been provided in the front section of the container. This actuable clamping bolt, in an preferred embodiment, is shaped like an elbow lever clamp. This clamp comprises a clamping lever mounted in position on the container as well as a tensioning pawl mounted on the clamping lever which can be made to engage an opposing element. An example of this opposing element is a bolt, clamp or other suitable hardware fitting on the respective adjoining container in the container stack.

To stack the containers on top of each other, the glide elements, which, in accordance with the invention, are adjustable as regards their position, are moved into an end position. In this position they are approximately in the area of the level of the container bottom, and in such a way that during stacking they would be positioned over the respective longitudinal edge of the container immediately located beneath it in the stack. By means of a lift-on, lift-off device known in the art, the container is picked up and made to slide over an already filled container on the ground. During this procedure the glide elements execute a traveling movement along the upper longitudinal edges of, for example, the filled container positioned on the ground. This movement continues until the glide elements engage the claw finger-shaped protruding rear projections of the bolting down elements. The front glide elements can be prevented from further movement by the front projections in the form of blocks. The container which has been moved to this point has reached its end position in the stack. Both stacked containers can be relatively tightly interconnected by inserting the tensioning pawl of the clamping bolt located on the lower container into the opposing element of the container stacked above it and by subsequently applying the clamping lever.

Figure 2:
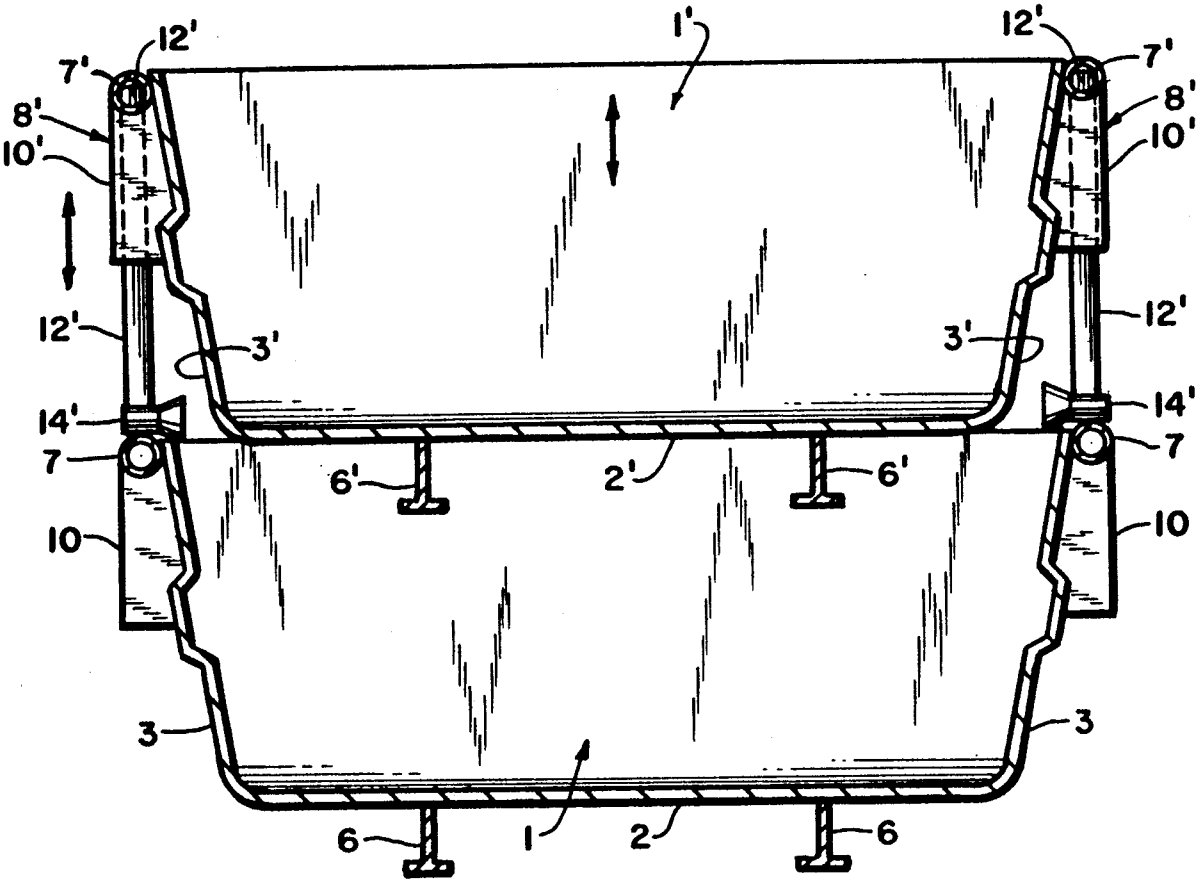
Figure 3:
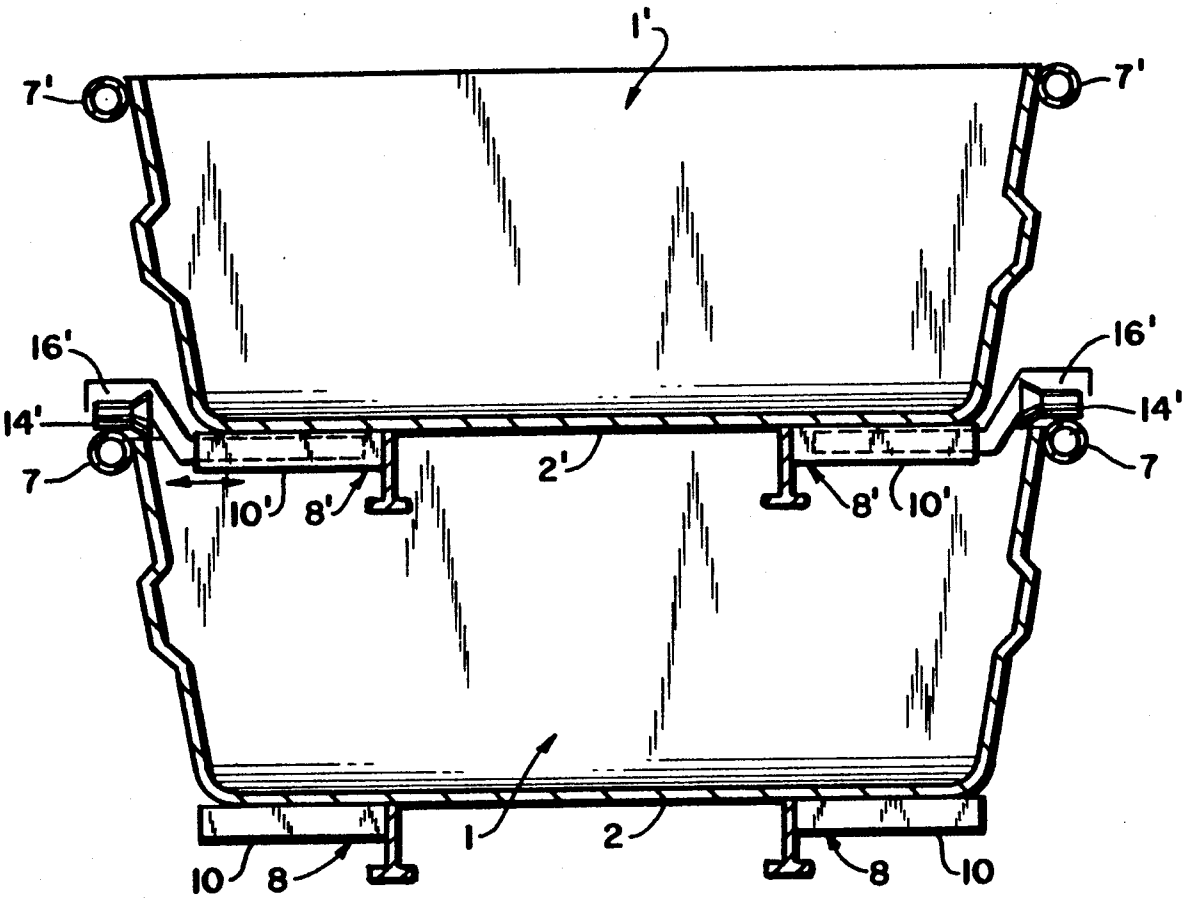

Exemplified embodiments, from which further inventive characteristics are evident, are shown in the drawings. Shown are, in:

FIG. 1 two interstacked containers in a schematic lateral view;

FIG. 2 the interstacked containers per FIG. 1, in a schematic cross-section, and FIG. 3 two interstacked containers in accordance with a second embodiment shown in a schematic cross-section.

FIG. 1 shows two identical containers 1 and 1' in a lateral view stacked on top of each other and ready for transport. Each container 1 and 1' is shaped like an open topped cradle with a rectangular foundation plan. Each container has a level bottom 2 and 2', walls 3 and 3', in addition to front walls 4 and 4' and rear walls 5 and 5'. Each container is outfitted with runners 6 and 6' which extend the entire length of the bottom 2 and 2'.

The upper longitudinal edges of the walls 3 and 3' of the containers are identified by 7 and 7'. Each container 1 and 1' displays locking elements 8 and 9 and 8' and 9' in the upper section of the container externally mounted on the walls 3 and 3' in approximately perpendicular alignment. The opposing walls of the container, not visible here, are also equipped with the same type of locking elements. Each locking element is a receptacle 10, 11 and 10', 11' in the shape of a hollow section, housing positioning elements 12, 13 and 12' and 13' inserted therein, whose unengaged ends which protrude out and downward from the locking elements are equipped with glide elements 14, 15 and 14' and 15'. Each adjusting element 12, 13 and 12', 13' is, with respect to the respective receptacle 10 and 11 and 10' and 11', a movable bar component 16, 17 and 16', 17'. In an embodiment of the receptacle 10 and 11 and 10', 11' as a hollow section, the adjusting element 12, 13 and 12', 13' configured as a bar component 16, 17 and 16' and 17' can be a sectional rod which is longitudinally slide-guided in the receptacle. The lower receptacle of the stack consisting of containers 1 and 1' is depicted with glide elements 14, 15 in the engaged position. The position of the glide elements corresponds to an end position in which the containers can be interstacked.

In container 1' the positioning elements 12' and 13' are extended so far out from the locking elements 8' and 9' configured as receptacles 10' and 11' that the glide elements 14' and 15' in the lower section of the container 1' are positioned over the respective longitudinal edge 7 of the container 1 immediately located below in the stack. In this position the glide elements 14' and 15' support the upper container 1' enabling filled containers to be stacked on top of each other.

Bolting down elements have been provided to secure interstacked containers 1 and 1' during transit. The bolting down elements consist of projections which protrude from the longitudinal edges into the sliding path of the glide elements 14', 15', up against which projections respective glide elements 14', 15' supported on these edges stop in the final stacking position and of at least one actuable clamping bolt 18 and 18'.

In this embodiment, a rear projection of the bolting down elements is shaped like a claw finger 19 and 19' projecting from the longitudinal edge 7 and 7' and which, laterally and from the top, engages in hook-like fashion a rear glide element 15, 15' supported on the respective longitudinal edge 7. A forward projection of the bolting down elements clasps two blocks 20 and 21 and 20' and 21', positioned one behind the other on the longitudinal edge 7 and 7' and accommodating a glide element 14' between them, which exhibit oblique slopes on the sides facing away from each other, as can be seen in FIG. 1.

Each clamping bolt 18 and 18' is configured like an elbow lever clamp and comprises a clamping lever 22 and 22' mounted in position on the respective container 1 and 1' as well as a tensioning pawl 23 mounted on the respective clamping lever which can be made to engage an opposing element 24 on the respective adjoining container 1 in the container stack. The opposing element can be a solder-mounted clamp, pin and correspondingly configured hardware fitting.

FIG. 2 shows a schematic cross-section of a stack formed from the containers 1 and 1' in FIG. 1. FIG. 2 shows that the containers, for purposes of their interstackability, have outward slanting sides which normally prevent filled containers from being stacked one on top of the other. Since, as has been described hereinbefore, the glide elements 14' and 15' of the container 1' can be adjusted in position on container 1' such that in an end position in the lower section of container 1' they are over the respective longitudinal edge 7 of the container immediately beneath it in the stack, such containers can also be stacked when they are filled because the glide elements, just as is already the case with container internesting, can be supported on the longitudinal edges of the container immediately beneath it. Identical parts are designated by identical reference numbers.

FIG. 3 depicts a stack formed from two containers 1 and 1' in a view corresponding to FIG. 2. In this practical embodiment the locking elements 8 and 8' are configured as hollow sections mounted in approximately horizontal alignment under the container bottom 2 and 2'. The glide elements 14' are again rollers mounted in position on the unengaged ends of the bar components 16'. The bar components 16', as shown, evidence an offset and, with their ends facing away from the glide elements, are inserted into the locking elements. Identical parts are again designated by identical reference numbers.

What is claimed is:

1. A container for the loading of bulk materials, such as construction debris, rubbish, industrial waste and capable of interstackability and of nesting, said container comprising upper longitudinal edges;

said container having two outwardly slanting sides and having glide elements enabling it to slide supported along the upper longitudinal edges of the container immediately below it in a stack;

said upper longitudinal edges comprising longitudinal guides, said container having a lower section and an upper section;

wherein there are four glide elements with there being two respective glide elements, positioned one behind the other in a longitudinal direction, on said two outwardly slanting sides, and said glide elements are supported on said upper longitudinal edges;

four positioning adjusting elements with there being one on which each of said four glide elements is arranged;

four receptacle locking means mounted on the container with their being one for securing each of said positioning elements in an adjustable, movable position on the container, said four receptacle locking means being located with two respective receptacle means vertically positioned one behind the other in the longitudinal direction on said two outwardly slanting sides of said container; and for achieving said interstackability, said glide elements being adjustable vertically downwardly by being provided on the container in such a way that when in their vertically downward position in the lower section of the container, the guide elements are positioned over the respective upper longitudinal edge of the container located immediately below it in the stack; and, for achieving nesting of said containers, said glide elements being adjustable vertically upwardly.

2. A container according to claim 1, wherein each glide element comprises a pivoted roller.

3. A container according to claim 1, wherein the positioning element comprises a bar component movable relative to the receptacle.

4. A container according to claim 3, wherein said receptacle has a hollow section; and wherein the bar component is a sectional rod within the hollow section.

5. A container according to claim 3, further comprising means for externally mounting each receptacle on the sides in the upper section of the container in an approximately perpendicular alignment.

6. A container for the loading of bulk materials, such as construction debris, rubbish, and industrial waste capable of interstackability and of nesting, said container comprising upper longitudinal edges;

said container having two outwardly slanting sides and having glide elements enabling it to slide supported along the upper longitudinal edges of the container immediately below it in a stack;

said upper longitudinal edges comprising longitudinal guides, said container having a bottom;

said container bottom having sides and having a centerline;

wherein there are four glide elements with there being two respective glide elements, positioned one behind the other in a longitudinal direction on said upper longitudinal edges, and said glide elements are supported on said upper longitudinal edges;

four positioning adjusting elements with there being one on which each of said four glide elements is arranged, each positioning element is on the upper longitudinal edge;

four receptacle locking means mounted under the bottom of the container for securing each of said positioning elements in an adjustable, movable horizontal position under the bottom of the container, said four receptacle locking means being located with two respective receptacle means horizontally positioned one behind the other in the longitudinal direction on the sides of the bottom of the container;

for achieving said interstackability, said glide elements being adjustable horizontally from said bottom sides toward said bottom centerline of the container immediately above it by being provided on the container in such a way that when in their horizontal position on the upper longitudinal edges of the container, the guide elements are positioned beneath the bottom of the container located immediately above it in the stack; and for achieving said nesting, said glide elements being adjustable horizontally from said bottom centerline of the container toward said upper longitudinal edges of the container.

7. A container according to claim 6, wherein the positioning adjusting element is located in the receptacle locking means and has an offset in its end section which faces the glide element.

8. A container according to claim 1, wherein the locking element locks at least one of the end positions of the glide elements in place.

9. A container according to claim 8, wherein each locking element comprises intercongruent bores in the bar component and in the receptacle; and a connector pin for plugging into the bores.

10. A container according to claim 1, further comprising bolting down elements for securing interstacked containers during transit.

11. A container according to claim 10, wherein the bolting down elements comprise projections which protrude from the longitudinal edges into the sliding path of the glide elements, up against which projections the respective glide elements supported on these edges stop in the final stacking position; and at least one actuable clamping bolt.

12. A container according to claim 11, further comprising a rear projection shaped like a claw finger and protruding from the longitudinal edge;

a rear glide element supported on the respective longitudinal edge; and said rear projection laterally and from the top engaging in hook-like fashion said rear guide element.

13. A container according to claim 11, further comprising a forward projection clasp including two blocks, with each block having sides facing away from each other and positioned one behind the other on the longitudinal edge;

said blocks accommodating a glide element between them; and said blocks exhibiting oblique slopes on the sides facing away from each other.

14. A container according to claim 13, wherein at least one of the blocks is separately connected to the longitudinal edge.

15. A container according to claim 11:

wherein each actuable clamping bolt is shaped like an elbow lever clamp and comprises a clamping lever mounted in position on the container;

a tensioning pawl mounted on the clamping lever; and an opposing element on the respective adjoining container in the container stack; and said tensioning pawl capable of engaging said opposing element.

* * * * *